US008223992B2

(12) United States Patent
Suzuki et al.

(10) Patent No.: US 8,223,992 B2
(45) Date of Patent: Jul. 17, 2012

(54) SPEAKER ARRAY APPARATUS

(75) Inventors: Koji Suzuki, Iwata (JP); Yusuke Konagai, Hamamatsu (JP)

(73) Assignee: Yamaha Corporation (JP)

( * ) Notice: Subject to any disclaimer, the term of this patent is extended or adjusted under 35 U.S.C. 154(b) by 957 days.

(21) Appl. No.: 12/167,414

(22) Filed: Jul. 3, 2008

(65) Prior Publication Data

US 2009/0010455 A1 Jan. 8, 2009

(30) Foreign Application Priority Data

Jul. 3, 2007 (JP) ..... 2007-175489

(51) Int. Cl.
*H04R 1/40* (2006.01)

(52) U.S. Cl. ..... 381/97; 381/1; 381/17; 381/18; 381/310; 381/56; 381/58

(58) Field of Classification Search ..... 381/1, 17, 381/18, 310, 97, 56, 58
See application file for complete search history.

(56) References Cited

U.S. PATENT DOCUMENTS

| | | | | |
|---|---|---|---|---|
| 5,999,630 | A | 12/1999 | Iwamatsu | |
| 2005/0117753 | A1 | 6/2005 | Miura et al. | |
| 2006/0126878 | A1 * | 6/2006 | Takumai et al. | 381/335 |
| 2006/0210101 | A1 | 9/2006 | Ishibashi et al. | |
| 2006/0269070 | A1 | 11/2006 | Miura et al. | |
| 2008/0165979 | A1 | 7/2008 | Takumai | |
| 2008/0226084 | A1 | 9/2008 | Konagai et al. | |
| 2009/0028358 | A1 | 1/2009 | Suzuki | |

FOREIGN PATENT DOCUMENTS

| | | | |
|---|---|---|---|
| JP | 57-023691 | A | 2/1982 |
| JP | 8-051698 | A | 2/1996 |

(Continued)

OTHER PUBLICATIONS

Office Action issued in the Japanese Patent Office for Japanese Patent Application No. JP-2007-175489 dated Jul. 23, 2009—"Notification of Reasons for Refusal" (Full Translation).

(Continued)

*Primary Examiner* — Kimberly Nguyen
*Assistant Examiner* — Mohammad T Karimy
(74) *Attorney, Agent, or Firm* — Rossi, Kimms & McDowell LLP

(57) ABSTRACT

A speaker array apparatus includes a speaker array that emits sounds of a plurality of channels, a beam formation calculating section that performs a calculation for controlling phases of the sounds so that the speaker array emits sound beams in directions set for the respective channels, a sound source localization applying section that performs a calculation for controlling the phases of the sounds emitted from the speaker array so as to form a plurality of virtual point sound sources, and performs a calculation of auditory sensation characteristics at a listening position on a basis of a head-related transfer function, a selecting section that selects one of the beam formation calculating section and the sound source localization applying section, and a phase controlling section that controls the phases of the sounds emitted from the speaker array on a basis of a calculation result of the beam formation calculation section which is selected by the selecting section or applies the auditory sensation characteristics and controls the phase of a wavefront from the virtual point sound source on a basis of a calculation result of the beam formation calculating section which is selected by the selecting section.

8 Claims, 8 Drawing Sheets

FOREIGN PATENT DOCUMENTS

| | | | |
|---|---|---|---|
| JP | 8-146974 | A | 6/1996 |
| JP | 9-046800 | A | 2/1997 |
| JP | 2966181 | B2 | 8/1999 |
| JP | 2000-295698 | A | 10/2000 |
| JP | 3205625 | B2 | 6/2001 |
| JP | 2005-012765 | A | 1/2005 |
| JP | 2005-167612 | A | 6/2005 |
| JP | 2006-013711 | A | 1/2006 |
| JP | 2006-060610 | A | 3/2006 |
| JP | 2006-246310 | A | 9/2006 |
| JP | 2006-258442 | A | 9/2006 |
| JP | 2006-303658 | A | 11/2006 |
| JP | 2006-313980 | A | 11/2006 |
| JP | 2006-340302 | A | 12/2006 |
| JP | 2007-049413 | A | 2/2007 |
| JP | 2007-068000 | A | 3/2007 |
| JP | 2007-110744 | A | 4/2007 |
| JP | 2008-227803 | A | 9/2008 |
| WO | 2006/001272 | A1 | 1/2006 |

OTHER PUBLICATIONS

Japanese Office Action, Notification of Reasons of Refusal, corresponding to JP2007-190835, dated Jul. 23, 2009, co-pending application US 2009-0010455. English translation provided.

Co-Pending application US 2009-0010455, Specification with claims and drawings.

* cited by examiner

SPEAKER ARRAY APPARATUS

BACKGROUND

The present invention relates to a speaker array apparatus for a surround system which is able to install freely in the installation location.

FIG. 1 is a view showing an example of a surround sound field produced by a conventional surround system. Conventionally, a surround system in which a surround sound field is provided by a simple configuration is proposed. For example, as shown in FIG. 1A, a technique of a speaker apparatus is disclosed that sound emission timings of speaker units of a speaker array 101 are adjusted to form plural sound beams, and the sound beams are reflected by the wall of a room, whereby a realistic surround sound field can be produced in the periphery of a listener U (for example, see Patent Reference 1).

Furthermore, as shown in FIG. 1B, a technique relating to a sound field signal reproducing apparatus is disclosed that frequency characteristics calculated on the basis of a head-related transfer function are given to sounds of respective channels so as to virtually localize a sound image in the periphery of the listener U, and a pair of speaker units 111, 113 that are placed in front of the listener U emit sounds of plural channels toward the listener, whereby a virtual surround sound field can be produced in the periphery of the listener U (for example, see Patent Reference 2).

[Patent Reference 1] JP-B-3205625

[Patent Reference 2] JP-B-2966181

In the apparatus which produces a realistic surround sound field by means of sound beams, the sound beams are reflected by the wall of a room. When an obstacle is existed in the reflection path of the sound beams, or when a wall which reflects the sound beams does not exist, consequently, there is a case where a surround sound field cannot be properly produced.

In the apparatus which produces a virtual surround sound field, by contrast, a surround sound field is virtually produced on the basis of a head-related transfer function, and hence a space where a surround sound field can be provided is very narrow. Therefore, the listening position is limited.

SUMMARY

It is an object of the invention to provide a speaker array apparatus for a surround system which can produce a surround sound field according to the installation environment.

In the invention, the apparatus comprises the following configurations as means for solving the problem.

(1) A speaker array apparatus comprising:

a speaker array that emits sounds of a plurality of channels;

a beam formation calculating section that performs a calculation for controlling phases of the sounds so that the speaker array emits sound beams in directions set for the respective channels;

a sound source localization applying section that performs a calculation for controlling the phases of the sounds emitted from the speaker array so as to form a plurality of virtual point sound sources, and performs a calculation of auditory sensation characteristics at a listening position on a basis of a head-related transfer function;

a selecting section that selects one of the beam formation calculating section and the sound source localization applying section; and a phase controlling section that controls the phases of the sounds emitted from the speaker array on a basis of a calculation result of the beam formation calculation section which is selected by the selecting section or applies the auditory sensation characteristics and controls the phase of a wavefront from the virtual point sound source on a basis of a calculation result of the sound source localization applying section which is selected by the selecting section.

Preferably, the phases of the sounds emitted from the speaker array is controlled so that a wavefront formed by the sounds emitted from the speaker array is similar to a wavefront formed by sounds emitted from the virtual point sound sources. The auditory sensation characteristics are calculated so that a listener who listens at the listening position to the sounds emitted from the virtual point sound sources feels localization at positions set for the respective channels.

According to the configuration, in the speaker array apparatus, when the beam formation calculating section is selected by the selecting section, a calculation for producing a realistic surround sound field by direct sounds and reflected sounds which are obtained by reflecting sound beams by a wall is performed by the beam formation calculating section. In the speaker array apparatus, when the sound source localization applying section is selected by the selecting section, the sound source localization applying section performs a calculation for producing a virtual surround sound field so as to virtually localize a sound image in the periphery of the listener. On the basis of a calculation result of the selected section, the phase controlling section controls the phase of the sound signals output from the plural speaker units, or applies the auditory sensation characteristics and controls the phase of a wavefront from the virtual point sound source. In the speaker array apparatus, therefore, the formation of a realistic surround sound field or that of a virtual surround sound field can be selected by the selecting section, and hence an optimum surround environment according to the installation environment can be set.

(2) The speaker array apparatus further comprises:

a test sound outputting section that outputs a test sound signal and a signal for controlling the phases to the phase controlling section so that the speaker array emits test sound beams while sweeping the test sound beams; and a microphone that is disposed at the listening position of the listener, and picks up direct and reflected sounds of the test sound beams emitted from the speaker array, and wherein the selecting section analyzes sound data of the test sound beams which are picked up by the microphone, and selects one of the beam formation calculating section and the sound source localization applying section in accordance with a result of the analysis.

Preferably, the speaker array apparatus further comprises:

an operating section that receives an operation of checking an environment, wherein the test sound outputting section outputs the test sound signal and the signal for controlling the phases, when the operating section receives an operation of checking an environment.

According to the configuration, in the speaker array apparatus, when the operating section receives the operation of checking an environment, the speaker array emits test sound beams while sweeping the test sound beams, and the microphone which is installed at the listening position picks up direct and reflected sounds of the test sound beams emitted from the speaker array. The features of the picked-up sound data of the test sound beams are analyzed, and, in accordance with a result of the analysis, one of the beam formation calculating section and the sound source localization applying section is selected and operated. In the speaker array apparatus, when the operation of checking an environment is received, therefore, it is automatically determined in accordance with the installation location whether a realistic surround sound field or a virtual surround sound field is produced, and an optimum surround sound field according to the installation environment can be produced.

(3) The apparatus further comprises:

a position detecting section that detects the listening position of the listener, and outputs information of the position, wherein, when the sound source localization applying section is selected by the selecting section and the position information output from the position detecting section is changed, the sound source localization applying section performs the calculation for controlling the phases of the sounds emitted from the speaker array, or the calculation of the auditory sensation characteristics.

According to the configuration, in the speaker array apparatus, when, during production of a virtual surround sound field, the position detecting section detects that the listening position of the listener is changed, the calculation for controlling the phases of the sounds emitted from the array speaker, or the calculation of the auditory sensation characteristics in which the listener feels localization at positions set for the respective channels is performed. Even in the virtual surround mode, therefore, the listening position is not limited, and the listener can listen to the sounds at a desired position. When the listener changes the listening position, it is necessary only to perform a specific calculating process. Therefore, the calculating process after the change of the listening position can be simplified.

(4) When the listening position is changed, the sound source localization applying section performs a calculation for controlling the phases of the sounds emitted from the speaker array so that positions of the virtual point sound sources are changed in positional relationships similar to the virtual point sound sources relative to the listening position before the change, and a wavefront similar to a wavefront formed by the sounds emitted from the virtual point sound sources before the change is formed.

According to the configuration, when the listening position is changed, the sound source localization applying section changes the positions of the virtual point sound sources so as to establish positional relationships between the virtual point sound sources and the listening position similar to those established before the change of the listening position, and performs a calculation of the phase control for forming a wavefront similar to that formed by sounds emitted from the virtual point sound sources in which their positions are changed. In the speaker array apparatus, therefore, the positions of the virtual point sound sources are changed so as not to change the positional relationships, and hence it is not required to again perform a calculation for applying virtual localization of the surround sound field, so that the calculation result before the change of the listening position can be used. Consequently, it is necessary only to perform the calculation of the phase control for forming the wavefront of sounds emitted from the virtual point sound sources, and the calculating process can be simplified.

(5) When the listening position is changed, the sound source localization applying section performs a calculation of a phase control to delay sound emission timings of the virtual point sound sources so that arrival times of sounds to the listening position after the listening position is changed are substantially identical with arrival times of sounds to the listening position before the listening position is changed.

According to the configuration, when the listening position is changed, the sound emission timings of the virtual point sound sources are delayed so that the arrival times of sounds to the listening position after the change are substantially identical with those of sounds before the change, whereby an effect similar to that in the case where the positions of the virtual point sound sources are changed can be attained. Even when the calculation for changing the positions of the virtual point sound sources or that for changing virtual localization of the surround sound field is not performed, therefore, the calculation result before the change of the listening position can be used, and hence the surround sound field can be virtually localized to the changed listening position, simply by performing the calculation of a phase control in which sound emission timings of the virtual point sound sources are delayed, so that the calculating process can be simplified.

(6) When the listening position is changed, the sound source localization applying section calculates, on the basis of the head-related transfer function, the auditory sensation characteristics at the listening position after changed.

According to the configuration, in the speaker array apparatus, when the listening position is changed, the calculation result before the change of the listening position can be used, and a virtual surround sound field can be produced at the new listening position, simply by performing a calculation on the basis of the head-related transfer function. Therefore, the calculating process can be simplified.

(7) The sound source localization applying section performs a calculation for controlling the phases of the sounds emitted from the speaker array so that positions of the virtual point sound sources are changed in same positional relationships as the virtual point sound sources relative to the listening position before the change, and a wavefront similar to a wavefront formed by sounds emitted from the virtual point sound sources before the change is formed when the changed listening position is within a predetermined range in front of the speaker array. The sound source localization applying section performs a calculation of a phase control to delay sound emission timings of the virtual point sound sources when the changed listening position is outside the predetermined range.

According to the configuration, the process of producing a virtual surround sound field is changed in accordance with the set position of the changed listening position. Therefore, adequate setting in accordance with the new listening position is enabled.

In the speaker array apparatus of the invention, in accordance with the environment of the installation place, a realistic surround sound field can be formed by reflecting sound beams by a wall, and also a virtual surround sound field can be formed by producing virtual point sound sources. Therefore, the speaker array apparatus can be freely installed without concern for its installation location.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1A:
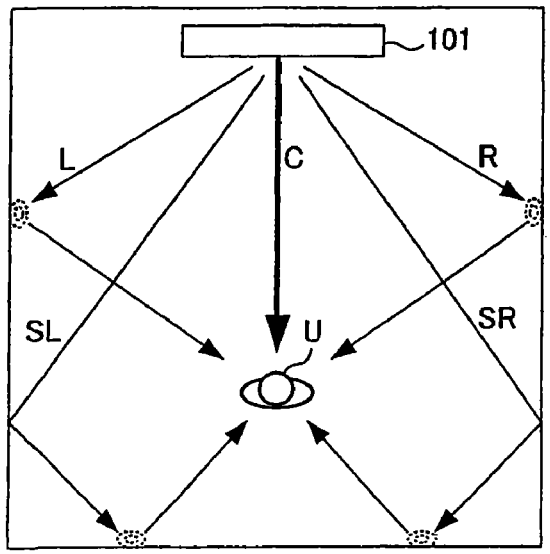
FIGS. 1A and 1B are views showing an example of a surround sound field produced by a conventional surround system.
Figure 1B:
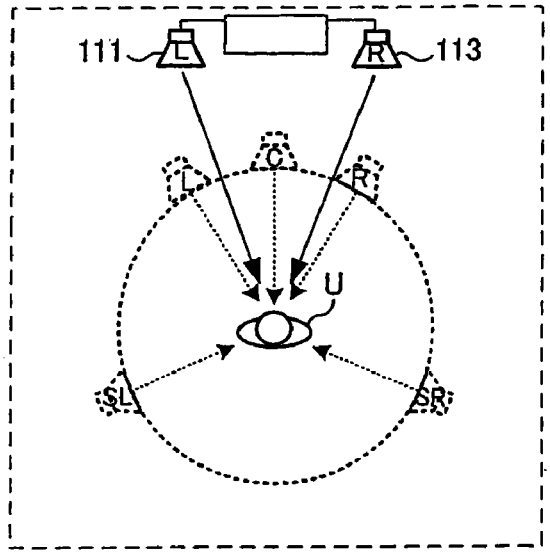
Figure 2:
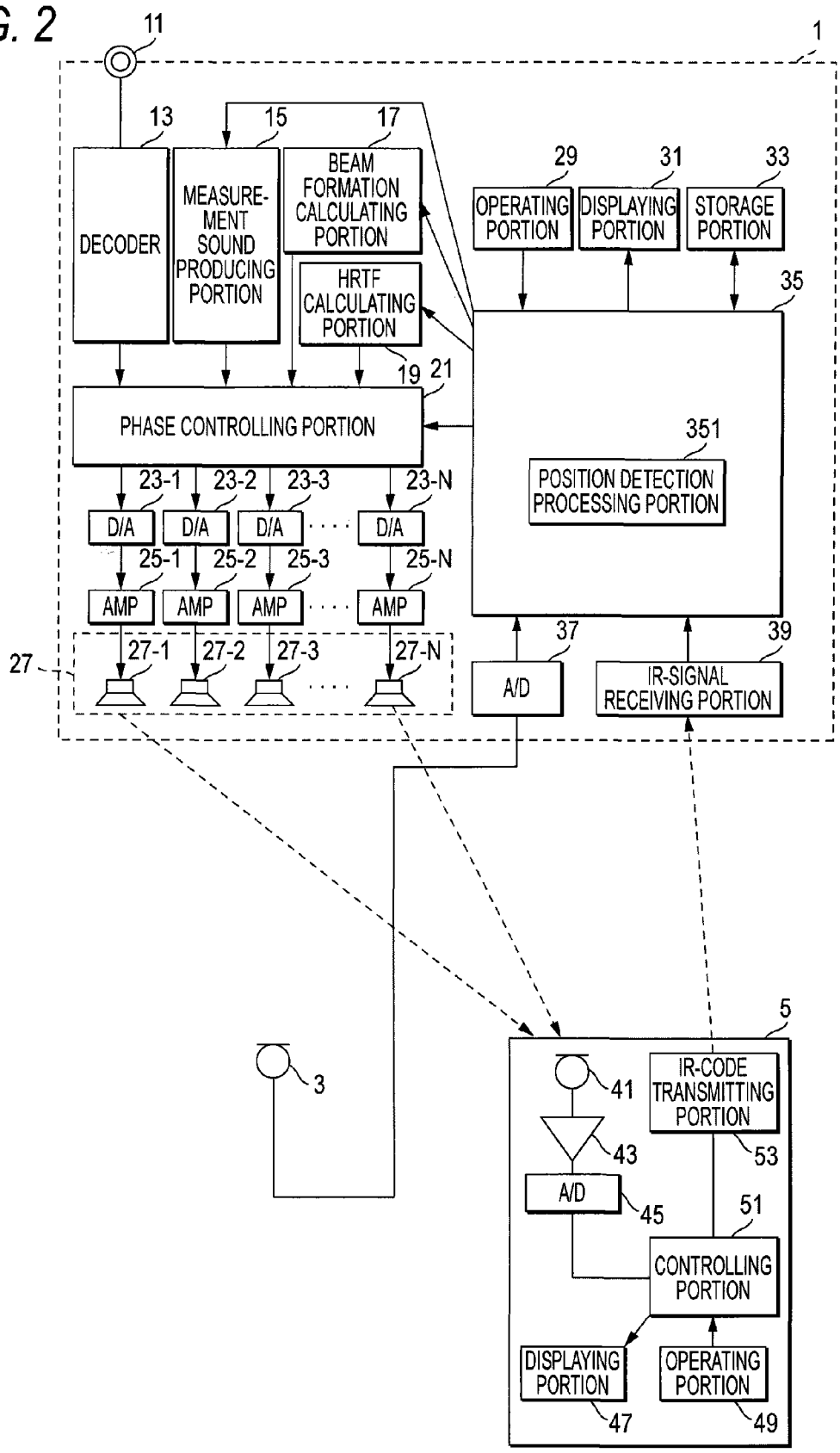
FIG. 2 is a block diagram schematically showing the configuration of a speaker array apparatus of an embodiment of the invention.

FIG. 2 is a block diagram schematically showing the configuration of a speaker array apparatus of an embodiment of the invention. Hereinafter, a speaker array apparatus for a 5-ch surround system will be exemplarily described. In the following description, with respect to the 5-ch channels, the front left channel is referred to as L (Left) ch, the front right channel is referred to as R (Right) ch, the center channel is referred to as C (Center) ch, the rear left channel is referred to as SL (Surround Left) ch, and the rear right channel is referred to as SR (Surround Right) ch.

First, the configuration of the speaker array apparatus 1 will be specifically described. As shown in FIG. 2, the speaker array apparatus 1 includes an input terminal 11, a decoder 13, a measurement sound producing portion 15, a beam formation calculating portion 17, a head-related transfer function calculating portion (hereinafter, referred to as HRTF calculating portion) 19, a phase controlling portion 21, D/A converters 23-1 to 23-N, power amplifiers 25-1 to 25-N, a speaker array 27 consisting of speaker units 27-1 to 27-N, an operating portion 29, a displaying portion 31, a storage portion 33, a controlling portion 35, an A/D converter 37, and an IR-signal receiving portion 39. The controlling portion 35 includes a position detection processing portion 351.

The input terminal 11 is connected to an external audio apparatus (not shown) to receive a digital surround sound signal output from the external audio apparatus.

The decoder 13 decodes the digital surround sound signal supplied through the input terminal 11 to five-channel sound signals, and supplies the five-channel sound signals to the phase controlling portion 21.

In accordance with output instructions from the controlling portion 35, the measurement sound producing portion 15 supplies a test sound signal or a test pulse signal to the phase controlling portion 21. As the test sound signal, for example, a narrow band sound wave which is centered at 4 kHz without periodicity, and a sound wave having no periodicity, e.g. whitenoise may be used. As the test pulse signal, an impulse signal or a signal with short white noises may be used.

When the operation is selected by the controlling portion 35, the beam formation calculating portion 17 performs a calculation for delaying the sound signals of the channels by a required amount in order to form a surround sound field due to sound beams in the periphery of the listener, and supplies a result of the calculation to the phase controlling portion 21.

When the operation is selected by the controlling portion 35, the HRTF calculating portion 19 calculates, on the basis of a head-related transfer function, auditory sensation characteristics (frequency characteristics) in which the listener feels localization in a direction (for example, conforming to ITU-R BS.775-1) suitable for the sound signals of the channels, and supplies a result of the calculation to the phase controlling portion 21.

The phase controlling portion 21 controls the phases of sound signals to be distributed to a part or all of the D/A converters 23-1 to 23-N, or gives the auditory sensation characteristics and controls the phases, on the basis of the calculation result supplied from the beam formation calculating portion 17 or the HRTF calculating portion 19 and instructions from the controlling portion 35. When the test sound signal supplied from the measurement sound producing portion 15 is distributed to the D/A converters 23-1 to 23-N, furthermore, the phase controlling portion 21 controls the phase of the test sound signal on the basis of instructions from the controlling portion 35. The phase controlling portion 21 outputs the test sound signal supplied from the measurement sound producing portion 15, to the D/A converters 23-1 and 23-N.

The D/A converters 23-1 to 23-N convert the digital sound signal supplied from the phase controlling portion 21 to an analog sound signal, and output the analog sound signal.

The power amplifiers 25-1 to 25-N amplify and output the analog sound signals supplied from the D/A converters 23-1 to 23-N.

In the speaker array 27, the speaker units 27-1 to 27-N are placed on one panel in a predetermined arrangement such as a matrix pattern, a linear pattern, or a honeycomb pattern. The speaker units 27-1 to 27-N convert the sound signals which are amplified by the power amplifiers 25-1 to 25-N, to sounds, and emit the sounds.

The operating portion 29 receives a setting operation or the like which is applied to the speaker array apparatus 1 by the listener, and outputs a signal corresponding to the operation, to the controlling portion 35.

The displaying portion 31 displays information to be transmitted to the listener, on the basis of a control signal supplied from the controlling portion 35.

The storage portion 33 stores the set pattern of the speakers, and the like data, and reads out data corresponding to an operation which is received by the controlling portion 35 through the operating portion 29. The storage portion temporarily stores sound data picked up by a microphone 3.

The controlling portion 35 controls various portions of the speaker array apparatus 1. When it is detected that an operation of selecting a surround sound field set mode is performed in the operating portion 29, the controlling portion 35 outputs a control signal to the measurement sound producing portion 15 and the phase controlling portion 21 to cause the test sound beams to be swept between one direction which is parallel to the front face of the speaker array 27 as viewing the speaker array 27 from the upper side (hereinafter, the direction is referred to as 0-degree direction), and the other direction which is parallel to the front face of the speaker array 27 (hereinafter, the direction is referred to as 180-degree direction).

The position detection processing portion 351 performs a process of detecting the positions of the microphone 3 and a remote controller 5. The position detection processing portion 351 measures arrival times t1, t2 from emissions of test pulses 1, 2 from the speaker units 27-1 and 27-N of the speaker array 27 to picks up of the test pulses 1, 2 by the microphone 3, calculates the position (listening position) of the microphone 3 by the triangulation method on the basis of the arrival times t1, t2, and outputs information of the listening position to the beam formation calculating portion 17 or the HRTF calculating portion 19.

Moreover, the position detection processing portion 351 measures arrival times t3, t4 from the emissions of the test pulses 1, 2 from the speaker units 27-1 and 27-N of the speaker array 27 to reception of an IR code transmitted for informing of picks up of the test pulses 1, 2 by a microphone 41 of the remote controller 5, calculates the position (listening position) of the remote controller 5 by the triangulation method on the basis of the arrival times t3, t4, and outputs information of the listening position to the beam formation calculating portion 17 or the HRTF calculating portion 19.

The A/D converter 37 converts an analog sound signal supplied from the microphone 3 to a digital sound signal, and outputs the digital sound signal to the controlling portion 35. The A/D converter 37 can be connected to and disconnected from the microphone 3, and is used in initialization of the listening position and checking of the installation environment of the speaker array apparatus 1.

In order that, when the speaker array apparatus 1 is installed at the listening position, a surround sound field according to the installation environment is set at the listening position, the microphone 3 is installed at the listening place of the listener. The microphone 3 is an omnidirectional microphone, picks up direct and reflected sounds of the test sound beams which are emitted from the speaker array 27 while being swept, and outputs a sound signal to the A/D converter 37. In detection of the position of the microphone 3, picked-up sound signals of the test pulses 1, 2 are supplied to the A/D converter 37.

Upon receiving an IR (infrared) signal output from the remote controller 5, the IR-signal receiving portion 39 converts the signal to an electric signal, and then supplies the electric signal to the controlling portion 35. In the speaker array apparatus 1, various settings and operations can be performed through the remote controller 5.

The remote controller 5 is used for performing various operations on the speaker array apparatus 1.

The remote controller 5 includes the microphone 41, an amplifier 43, an A/D converter 45, a displaying portion 47, an operating portion 49, a controlling portion 51, and an IR-code transmitting portion 53.

The microphone 41 is an omnidirectional microphone, picks up sounds propagated from the periphery, and outputs a sound signal to the amplifier 43.

The amplifier 43 amplifies the sound signal output from the microphone 41, and then supplies the signal to the A/D converter 45.

The A/D converter 45 converts (samples) the analog sound signal which is amplified by the amplifier 43, to a digital sound signal, and then outputs the digital sound signal to the controlling portion 51.

The displaying portion 47 displays messages indicative of an executed mode, an error, etc.

The operating portion 49 receives an operation performed by the listener.

The controlling portion 51 controls various portions of the remote controller 5.

The IR-code transmitting portion 53 outputs an IR (infrared) signal corresponding to a signal output from the controlling portion 51.

Figure 3A:
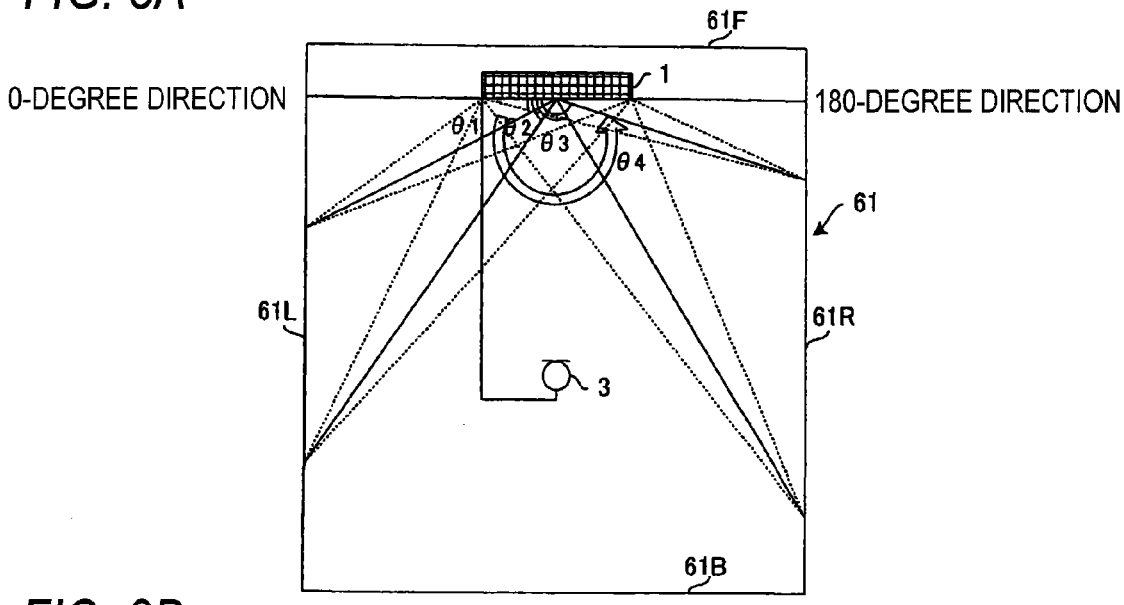
FIGS. 3A to 3C is a view illustrating the operation of an environment check mode in a room having a wall.
Figure 3B:
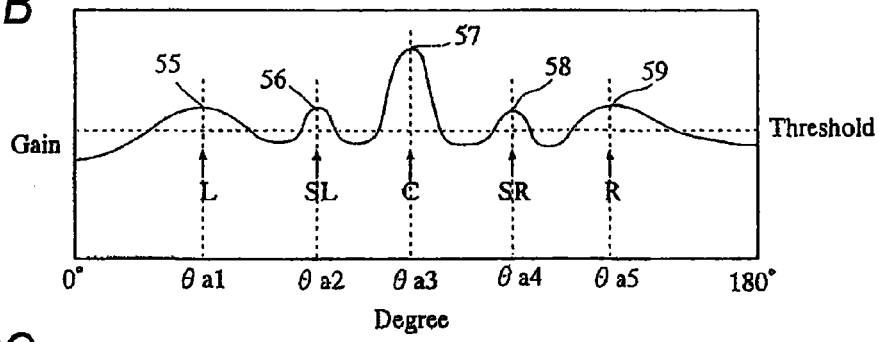
Figure 3C:
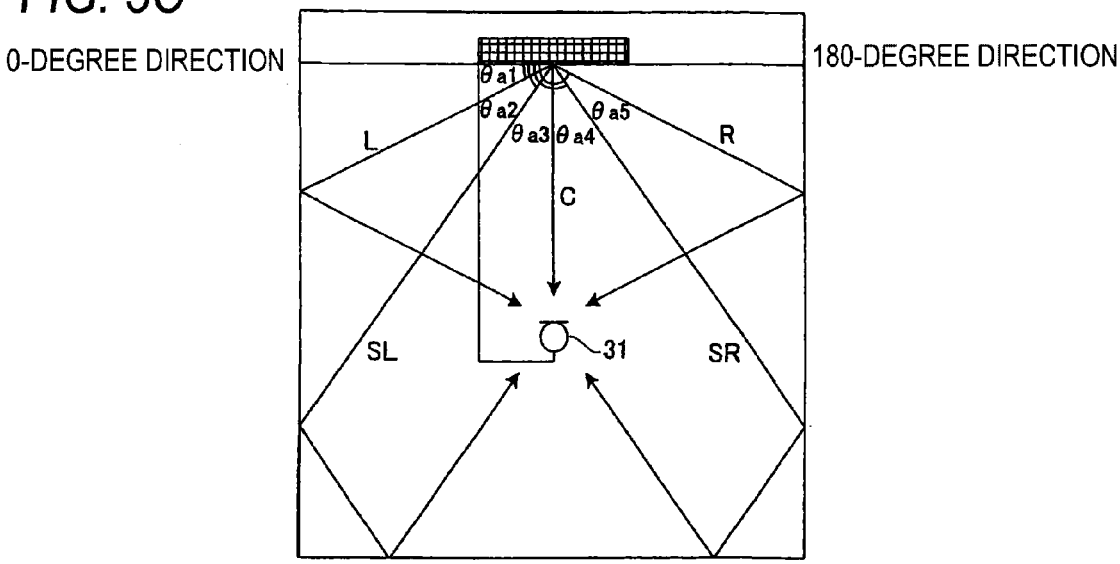
Figure 4A:
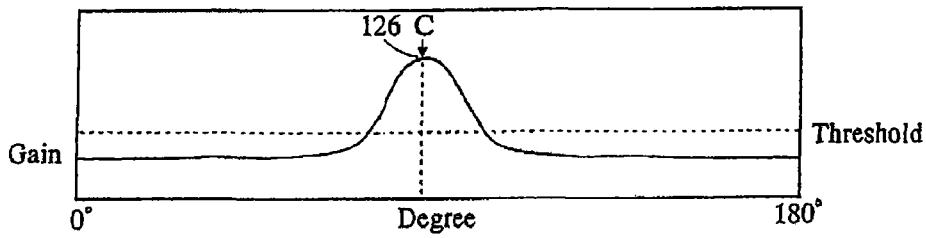
FIGS. 4A to 4C are views illustrating the operation of the environment check mode in a room having no wall.
Figure 4B:
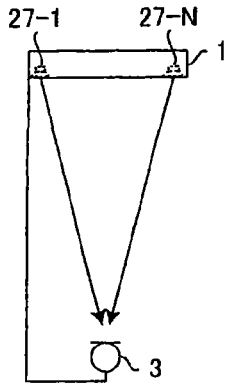
Figure 4C:
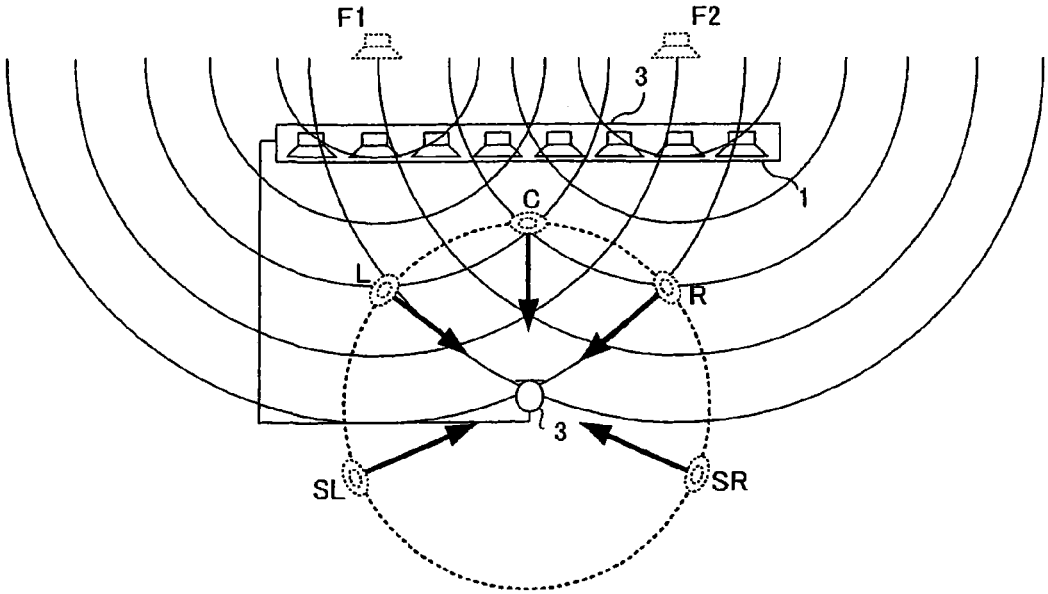
Figure 5:
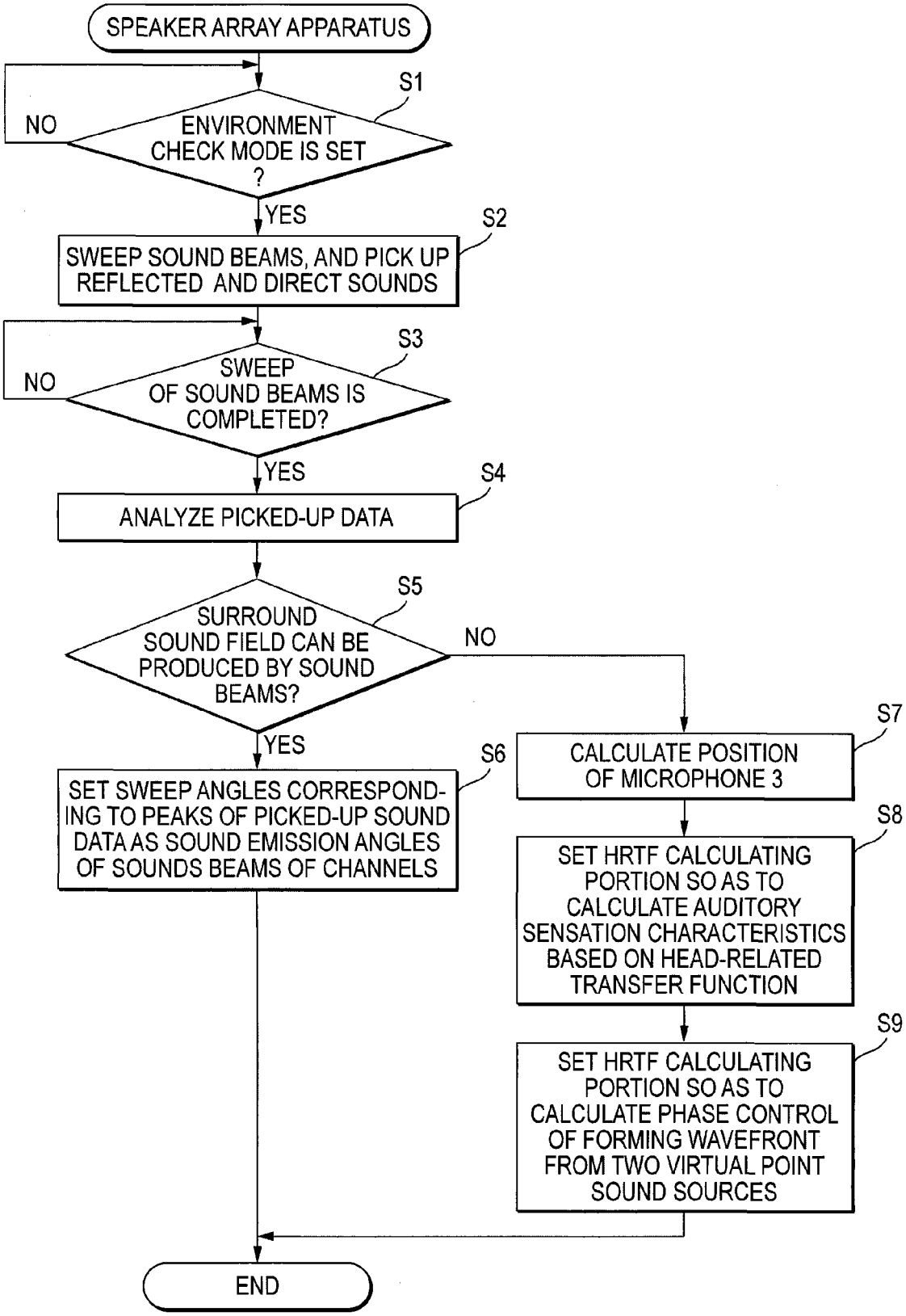
FIG. 5 is a flowchart illustrating the operation of the speaker array apparatus.

Next, the operation in the case where the speaker array apparatus 1 is installed will be described. FIGS. 3A to 3C are views illustrating the operation of an environment check mode in a room having a wall. FIG. 3A is a plan view of the room showing an operation in which the speaker array apparatus sweeps sound beams and the microphone picks up sounds, FIG. 3B is a graph of picked-up sound data which are measurement results in the case of the arrangement shown in FIG. 3A, and FIG. 3C is a view showing a state where a realistic surround sound field is set by the sound beams. FIGS. 4A to 4C are views illustrating the operation of the environment check mode in a room having no wall. FIG. 4A is a graph of picked-up sound data which are measurement results in the case where the speaker array apparatus sweeps sound beams, and the microphone picks up sounds, FIG. 4B is a view illustrating an operation of detecting the position of the microphone, and FIG. 4C is a view showing a state where a virtual surround sound field is set by sounds emitted from virtual point sound sources. FIG. 5 is a flowchart illustrating the operation of the speaker array apparatus.

In order to facilitate the understanding of the invention, the case where, in FIG. 3, the room 61 where the speaker array apparatus 1 is installed has an ideal shape or a rectangular parallelepiped shape, and the apparatus 1 is installed near the front wall 61F of the room 61 and in the vicinity of the middle of the front wall will be described.

In the speaker array apparatus 1, after the main unit is installed at the listening place, the microphone 3 is installed at the listening position of the listener, and the environment check mode is executed, whereby setting is performed so as to form an optimum surround sound field according to the installation place.

As shown in FIG. 3A, for example, the speaker array apparatus 1 is installed near the front wall 61F and in the vicinity of the middle of the front wall in parallel to the front wall 61F, and the microphone 3 connected to the A/D converter 37 of the speaker array apparatus 1 is installed at the listening position of the listener. At this time, the height of the microphone 3 may be coincident with the level of the ears of the listener. FIG. 3A shows the case where the listening position is set to be slightly behind the center of the room 61.

First, the listener installs the speaker array apparatus 1 at the listening place, and installs the microphone 3 at the listening position while connecting it to the A/D converter 37. Then, the listener operates the operating portion 29 of the speaker array apparatus 1 or the operating portion 49 of the remote controller 5 so as to set the execution of the environment check mode. The controlling portion 35 of the speaker array apparatus 1 waits until the execution of the environment check mode is set (s1: N). When it is detected that the environment check mode is set by the operation of the operating portion 29 or the operating portion 49 of the remote controller 5 (s1: Y), the controlling portion outputs the control signal to the measurement sound producing portion 15 and the phase controlling portion 21 to sweep the sound beams between the one direction which is parallel to the front face of the speaker array apparatus 1 as viewing the speaker array apparatus 1 from the upper side of the room 61 (hereinafter, the direction is referred to as 0-degree direction), and the other direction which is parallel to the front face of the speaker array apparatus 1 (hereinafter, the direction is referred to as 180-degree direction). Sounds (indirect sounds) reflected from the wall and direct sounds from the speaker array 27 are picked up by the microphone 3, and picked-up sound data are stored into the storage portion 33 (s2).

In FIG. 3A, sound beams at sweep angles θ1, θ2, θ3, and θ4 are simultaneously shown. FIG. 3A shows an example in which the beams converge at the vicinity of a wall 61L or 61R of the room 61. However, the form of the sound beams is not restricted to this. Alternatively, the sound beams may be first reflected by a wall and then converge, or the speaker array apparatus 1 may emit parallel sound beams or sound beams which are set so as to converge at a more remote position.

As shown in FIG. 3A, when sound beams are swept in front of the speaker array apparatus 1, the sound beams output from the speaker array apparatus 1 are reflected by the left wall 61L, rear wall 61B, or right wall 61R of the room 61 in accordance with the sweep angle θ of the sound beams, and advance toward the microphone 3 or in another direction. At this time, the microphone 3 picks up the direct sounds of the sound beams and the indirect sounds which are obtained by reflecting the sound beams by the walls. In the case where the sound beams advance toward the microphone 3, the gains of the sounds picked up by the microphone 3 are increased. By contrast, in the case where the sound beams advance in a direction different from the direction toward the microphone 3, the gains of the sounds picked up by the microphone 3 are decreased. In the speaker array apparatus 1, by using such characteristics, the sweep angle at which the gain has a peak value is obtained from the picked-up sound data, so that an angle optimal to output sound beams can be set.

The controlling portion 35 continues the sound pick-up until the sweep angle reaches 180 degrees, and stores the picked-up sound data into the storage portion 33 (s3: N, s2). When the sweep of the sound beams is completed (s3: Y), the picked-up sound data are read out from the storage portion 33, states such as the peak number, the peak levels, and symmetry are analyzed or compared with respective preset references, and it is determined whether a surround sound field can be produced by sound beams or not (s4).

In the case where plural peaks which are not lower than a threshold exist in the picked-up sound data, the controlling portion 35 selects and detects peaks which are in an adequate range, and which have a width that is not smaller than a fixed value. The controlling portion 35 performs the selection and the detection while excluding peaks having an angle that are impossible in an ordinary location as a peak interval or an installation angle of a virtual speaker, or peaks or the like of an unrecommended set angle. In the case where, even when the gain levels of peaks are not lower than the threshold, the waveform has a pulse-like shape, the width is not larger than the fixed value, and the waveform has a shape that is impossible as a sound beam, the controlling portion 35 excludes the waveform as noises.

If, as a result of the analysis, it is determined that a surround sound field can be produced by sound beams (s5: Y), the controlling portion 35 sets sweep angles corresponding to peaks of the picked-up sound data, in the beam formation calculating portion 17 as sound emission angles of sounds beams of the channels so that the phase control of emissions of sound beams of the channels from the speaker array 27 is calculated (s6). In the case where plural peaks which are not lower than the threshold exist in the picked-up sound data, namely, the controlling portion 35 sets the sweep angle of the peak which is in the adequate range, which has a width that is not smaller than a fixed value, and in which the gain level is highest, as the angle at which a C-ch sound beam is output. Furthermore, the controlling portion 35 selects and detects the number of peaks which exceed the gain threshold, in regions on the both sides (before and after in terms of time, right and left in terms of angle) of the peak that is set to C-ch, while excluding peaks which are excessively close to the C-ch peak, and which have an angle that are impossible in a common sense as an installation angle of a virtual speaker. When the peak numbers of the both sides of the C-ch peak are equal to each other, the controlling portion 35 allocates channels in the sequence of a surround channel and a front channel, to peaks in the order of the distance from the C-ch peak, and finds their angles.

When the setting of the emission angles of the sound beams of the channels is completed, the controlling portion 35 ends the process.

FIG. 3B shows picked-up sound data showing measurement results in the case of the arrangement shown in FIG. 3A. When picked-up sound data containing five symmetric peaks 55 to 59 are obtained as shown in FIG. 3B, the controlling portion 35 of the speaker array apparatus 1 sets an angle at which the L-ch sound beam is emitted, to a sweep angle θa1, that at which the SL-ch sound beam is emitted, to a sweep angle θa2, that at which the C-ch sound beam is emitted, to a sweep angle θa3, that at which the SR-ch sound beam is emitted, to a sweep angle θa4, and that at which the R-ch sound beam is emitted, to a sweep angle θa5, and sets these set values in the beam formation calculating portion 17. Therefore, the speaker array apparatus 1 is set so that a surround sound field is produced by the surround beams as shown in FIG. 3C.

By contrast, in the case where the speaker array apparatus 1 is installed in a room having no wall, sound beams cannot be reflected by a wall. Therefore, the speaker array apparatus 1 is caused to execute the environment check mode, and sound beams are swept in a room having no wall as shown in FIG. 3A. Then, the microphone 3 picks up only direct sounds from the speaker array apparatus 1. Consequently, picked-up sound data having one peak 126 as shown in FIG. 4A are obtained (s2, s3).

In the case where, as result of the analysis in step s4, only one peak in picked-up sound data exceeds the threshold (the case where there is no surrounding wall), or where plural peaks are detected but not symmetrical (for example, the case where no wall exists on the right and left sides of or behind the listening position), the controlling portion 35 determines that, in the environment, a surround sound field cannot be produced (s5: N), and starts an operation for producing a virtual surround sound field.

Namely, the controlling portion 35 outputs the control signal to the measurement sound producing portion 15 and the phase controlling portion 21 to cause the speaker units 27-1 and 27-N of the speaker array 27 to emit test sounds (position detection sounds), measures times which elapse until the microphone 3 picks up the both test sounds, and calculates the position of the microphone 3 by the triangulation method using the times (s7).

Then, the controlling portion 35 sets the HRTF calculating portion 19 so as to calculate auditory sensation characteristics (frequency characteristics) on the basis of a head-related transfer function so that, when the listener listens to sounds emitted toward the listener at the listening position from two virtual point sound sources F1, F2 which are set behind the speaker array apparatus 1 as shown in FIG. 4C, the listener feels localization in a direction that is set for each of peripheral channels (s8). Furthermore, the controlling portion 35 sets the HRTF calculating portion 19 so as to perform a calculation for controlling the phases of the sounds emitted from the speaker units 27-1 to 27-N so that a wavefront similar to that formed by sounds emitted from the two virtual point sound sources F1, F2 toward the listening position is formed (s9). Then, the controlling portion 35 ends the setting of the calculating process.

Although FIG. 4C shows the case where two virtual point sound sources are disposed, the invention is not restricted to this. Further plural virtual point sound sources may be disposed, and a wavefront similar to that formed by sounds emitted from these virtual point sound sources may be formed. For example, a virtual point sound source F3 may be disposed between the virtual point sound sources F1, F2 shown in FIG. 4C, and a sound wavefront may be formed so that a C-ch sound is emitted from the virtual point sound source F3 toward the listening position. According to the configuration, the C-ch sound can be surely localized to the front center portion of the listener.

In the speaker array apparatus 1, a surround sound field is automatically set by checking the installation environment as described above, and also the realistic surround sound mode or the virtual surround sound mode can be set by installing the microphone 3 at the listening position and causing the operating portion 29 or the listener to operate the operating portion 49 of the remote controller 5. When the realistic surround sound mode is set, the speaker array apparatus 1 performs setting so that sound beams are swept from the 0-degree direction to the 180-degree direction, sound data picked up by the microphone 3 are analyzed, sound emission angles of sounds beams of the channels are set, and the calculation for controlling the phases of the speaker units 27-1 to 27-N so as to emit sound beams at the sound emission angles is performed. When the virtual surround sound mode is set, the speaker array apparatus 1 performs setting so that the test pulses are emitted to calculate the position of the microphone 3, the phase control calculation is performed so as to, at the listening position, form a wavefront similar to that formed by sounds emitted from two virtual point sound sources, and sensation characteristics (frequency characteristics) in which a sound image is localized at the listening position in a direction that is set for each of the channels are calculated.

Next, in the case where the speaker array apparatus 1 is set so as to produce a virtual surround sound field, when the remote controller 5 is operated to change the listening position after the listener changes the listening position, the position of the virtual point sound source is changed so that an optimum surround sound field is produced at the changed listening position, and it is set so as to again calculate the position where the sound field is localized, on the basis of a head-related transfer function. According to the configuration, even in a virtual surround sound environment, the listening position can be easily changed.

Figure 6A:
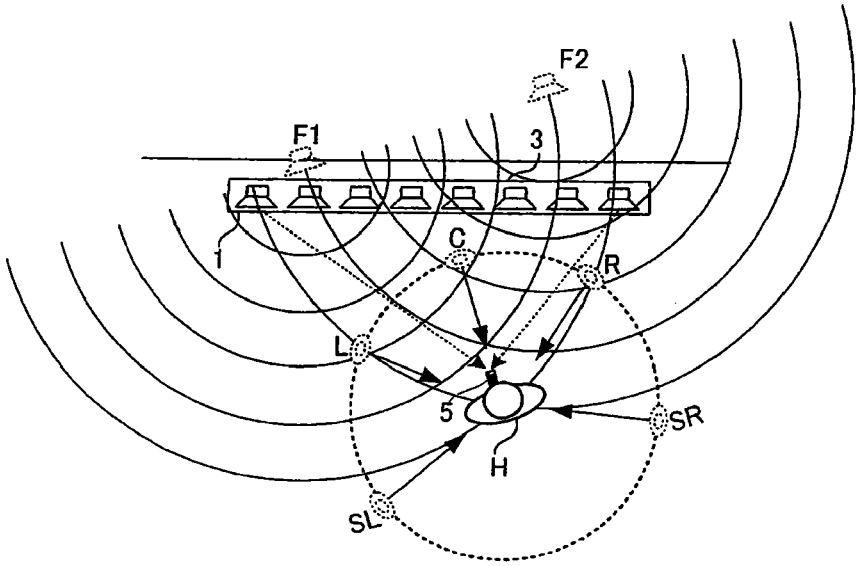
FIGS. 6A to 6C are views illustrating the procedure of again setting a virtual surround sound field after a listening position is changed.
Figure 6B:
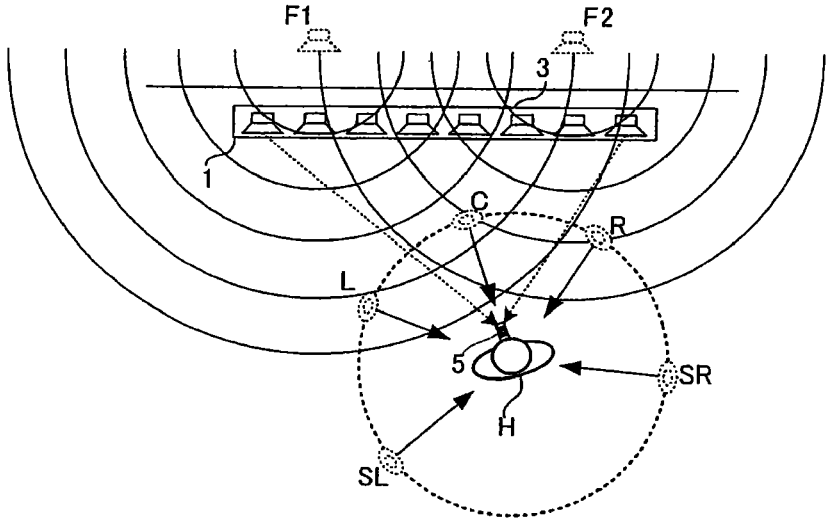
Figure 6C:
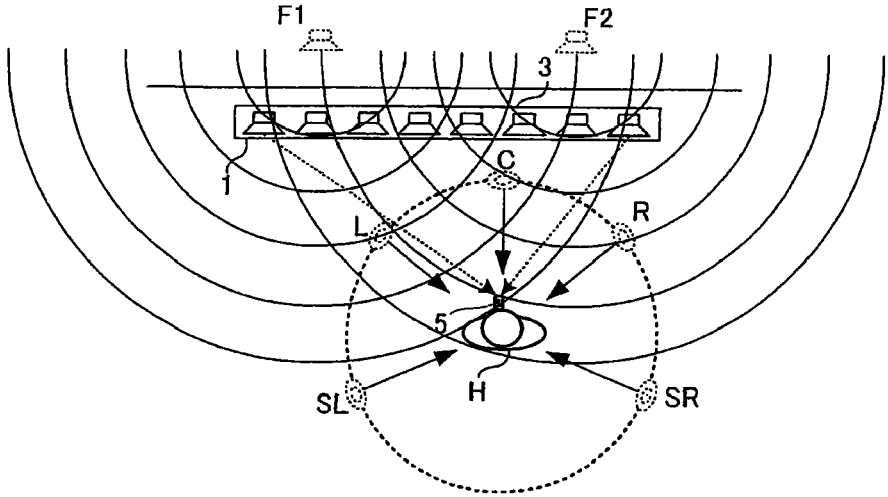

FIG. 6 is a view illustrating the procedure of again setting a virtual surround sound field after the listening position is changed, FIG. 6A shows a point sound source movement mode, FIG. 6B shows a delay control mode, and FIG. 6C shows a virtual localization movement mode.

In the speaker array apparatus 1, in the case where the virtual surround mode is set, when the listening position is to be changed, one of the point sound source movement mode in which the virtual point sound source is changed, the delay control mode in which the sound emission timing of the virtual point sound source is delayed (adjusted) so that sounds from two point sound sources propagate substantially simultaneously to the listening position, and the virtual localization movement mode in which the position of giving virtual localization is changed is selected, whereby the surround sound field can be set to be suitable to the new listening position.

In the case where the listener moves from the listening position shown in FIG. 4C in the vicinity of the front center of the speaker array apparatus 1 to that shown in FIG. 6A in the front right side of the speaker array apparatus 1, the listener may operate the remote controller 5 to select the point sound source movement mode, so that a virtual surround sound field is produced at the changed listening position.

Figure 7:
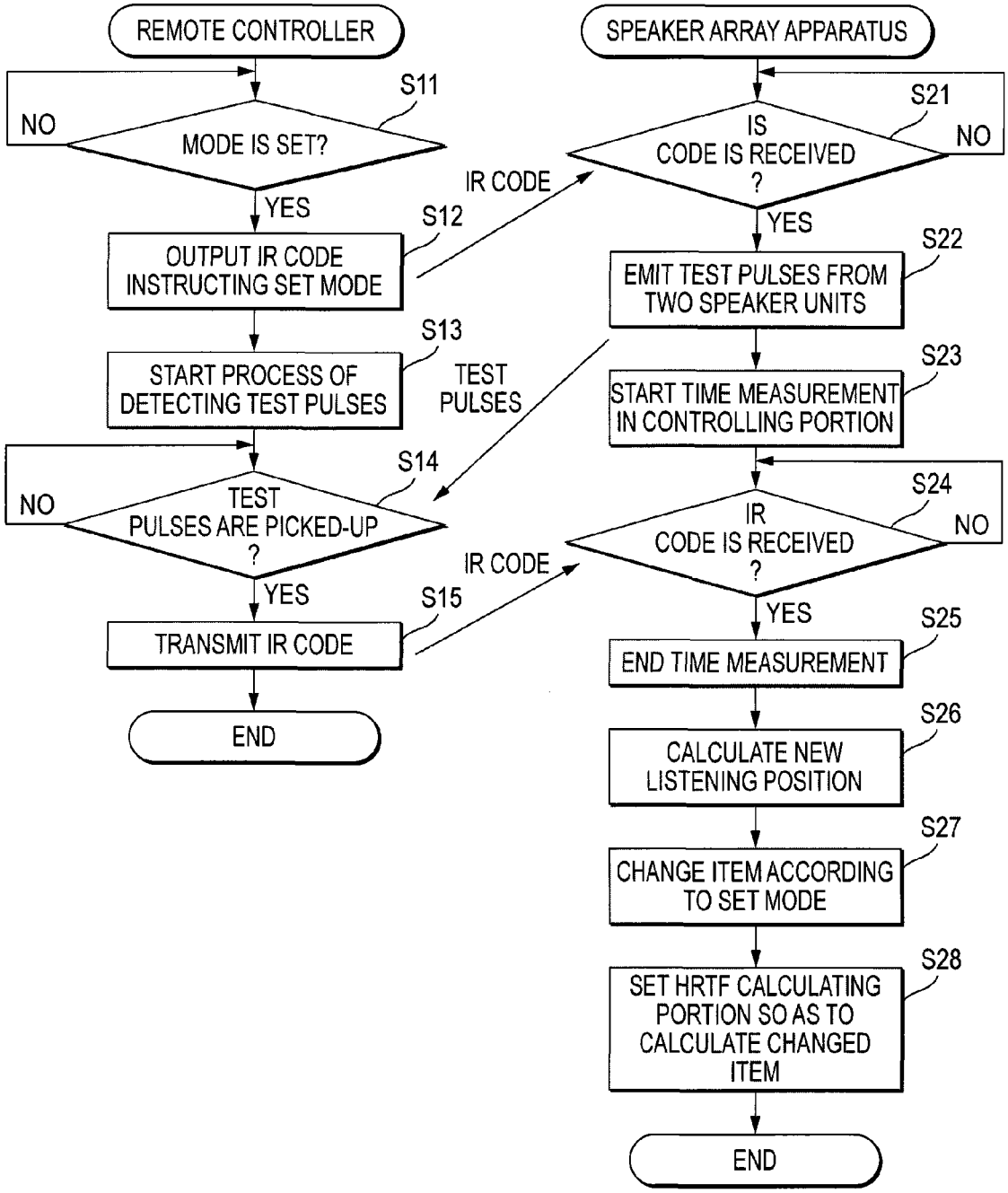
FIG. 7 is a flowchart illustrating the procedure of a point sound source movement mode.

FIG. 7 is a flowchart illustrating the procedure of the point sound source movement mode. When it is detected that the operating portion 49 is operated and the point sound source movement mode is set (s11: Y), the controlling portion 51 of the remote controller 5 controls the IR-code transmitting portion 53 to output an IR signal instructing the point sound source movement mode (s12), and sets the microphone 41 to a state where it can pick up the test pulses (s13).

When it is detected that the IR signal is received by the IR-signal receiving portion 39 and the point sound source movement mode is set (s21: Y), the controlling portion 35 of the speaker array apparatus 1 first causes the speaker units 27-1 and 27-N of the speaker array 27 to emit test pulses (s22). When the test pulses are emitted, the controlling portion 35 starts the time measurement (s23).

When the microphone 41 picks up the test pulses from the two speaker units (s14: Y), the controlling portion 51 of the remote controller 5 controls the IR-code transmitting portion 53 so as to immediately output an IR signal indicating of the pick up of the test sounds (s15).

When the IR signal from the remote controller 5 is received by the IR-signal receiving portion 39 (s24: Y), the controlling portion 35 of the speaker array apparatus 1 ends the time measurement (s25), and calculates the position of the remote controller 5 with respect to the speaker array apparatus 1, i.e., the new listening position by the triangulation method with using the times from the emissions of the test sounds from the speaker units 27-1 and 27-N to the reception of the IR signal from the remote controller 5 (s26).

In order to maintain the positional relationships between the two virtual point sound sources F1, F2 shown in FIG. 4C and the listening position, then, the controlling portion 35 changes the set positions of the two virtual point sound sources (s27). As shown in FIG. 6A, namely, on the rear side of the speaker array apparatus 1, the positions of the two virtual point sound sources F1, F2 are changed. Then, the HRTF calculating portion 19 is set so as to calculate the timings of sound emissions from the speaker array 27 so that a wavefront similar to that formed by sounds emitted from the two virtual point sound sources is formed (s28).

At this time, the HRTF calculating portion 19 performs the calculating process of giving auditory sensation characteristics (frequency characteristics) on the basis of a head-related transfer function so that the sound field is virtually localized in the periphery of the listener, while coefficients and the like are not changed even when the listening position is changed, and with using coefficients which are set before the change of the listening position.

As a result, when the speaker array apparatus 1 emits surround sounds, a surround sound field in which the listener U feels localization of the sounds in the periphery of the listener can be virtually produced as shown in FIG. 6A.

In the case where the listener moves from the listening position shown in FIG. 4C to that shown in FIG. 6B, even when the remote controller 5 is operated so as to select the delay control mode, it is possible to produce a virtual surround sound field at the changed listening position.

When it is detected that the operating portion 49 is operated and the delay control mode is set (s11: Y), the controlling portion 51 of the remote controller 5 outputs the IR signal instructing the point sound source movement mode (s12), and starts the process of picking up the test pulses (s13).

When it is detected that the IR signal is received by the IR-signal receiving portion 39 and the delay control mode is set (s21: Y), the controlling portion 35 of the speaker array apparatus 1 calculates the position of the remote controller 5, i.e., the new listening position of the listener in a similar manner as the case of the point sound source movement mode (s22 to s26, s14 and s15).

While maintaining the set positions of the two virtual point sound sources F1, F2 shown in FIG. 4, then, the controlling portion 35 is set so as to perform a delay control of delaying the sound emission timing of the virtual point sound source F2 (s27, s28).

At this time, the HRTF calculating portion 19 performs the calculating process of giving auditory sensation characteristics (frequency characteristics) on the basis of a head-related transfer function so that the sound field is virtually localized in the periphery of the listener, while coefficients and the like are not changed even when the listening position is changed, and with using coefficients which are set before the change of the listening position. The sound volumes (intensities) of the virtual point sound sources F1, F2 may be corrected in accordance with the distances from the virtual point sound sources F1, F2 to the listening position.

According to the configuration, a surround sound field in which the listener U feels localization of the sounds in the periphery of the listener can be virtually produced by delaying the timing of the calculating process of producing a wavefront with respect to the virtual point sound source F2, without changing the calculating process of forming a wavefront similar to that of sounds emitted from the virtual point sound sources, or by performing the delay and the correction of the sound volumes. Therefore, the calculating process can be simplified.

In the case where the listener moves from the listening position shown in FIG. 4C to that shown in FIG. 6C, the listener operates the remote controller 5 to select the virtual localization movement mode, so that a virtual surround sound field can be produced at the changed listening position. In this mode, preferably, the listener may not be obliquely directed to but opposed to the speaker array 27 as shown in FIG. 6C.

When it is detected that the operating portion 49 is operated and the virtual localization movement mode is set (s11: Y), the controlling portion 51 of the remote controller 5 outputs the IR signal (s12), and starts the process of picking up the test pulses (s13).

When it is detected that the IR signal is received by the IR-signal receiving portion 39 and the virtual localization movement mode is set (s21: Y), the controlling portion 35 of the speaker array apparatus 1 calculates the position of the remote controller 5, i.e., the new listening position of the listener in a similar manner as the case of the point sound source movement mode (s22 to s26, s14 and s15).

While the set positions of the two virtual point sound sources F1, F2 shown in FIG. 4C are maintained and the control of delaying the sound emission timing of the virtual point sound source is not performed, the controlling portion 35 sets the HRTF calculating portion 19 so as to change only the calculating process of giving auditory sensation characteristics (frequency characteristics) on the basis of a head-related transfer function so that the sound field is virtually localized in the periphery of the listener at the changed listening position (s27, s28). Namely, the set angle of the used head-related transfer function is changed in accordance with the listening position. The sound volumes (intensities) of the virtual point sound sources F1, F2 may be corrected in accordance with the distances from the virtual point sound sources F1, F2.

At this time, since the set positions of the two virtual point sound sources F1, F2 shown in FIG. 4C are maintained as described above, the calculation of the phase control can be performed with using the coefficients and the like which are set before the change of the listening position, and the HRTF calculating portion 19 performs the calculation of the phase control in the calculation procedure which is set before the change of the listening position.

According to the configuration, as shown in FIG. 6C, a surround sound field in which the listener U feels localization of the sounds in the periphery of the listener can be virtually produced by updating only the calculation for giving virtual localization of the surround sound field on the basis of the head-related transfer function for giving virtual localization, or the calculation and the adjustment of the sound volume. Therefore, the calculating process can be simplified.

Figure 8:
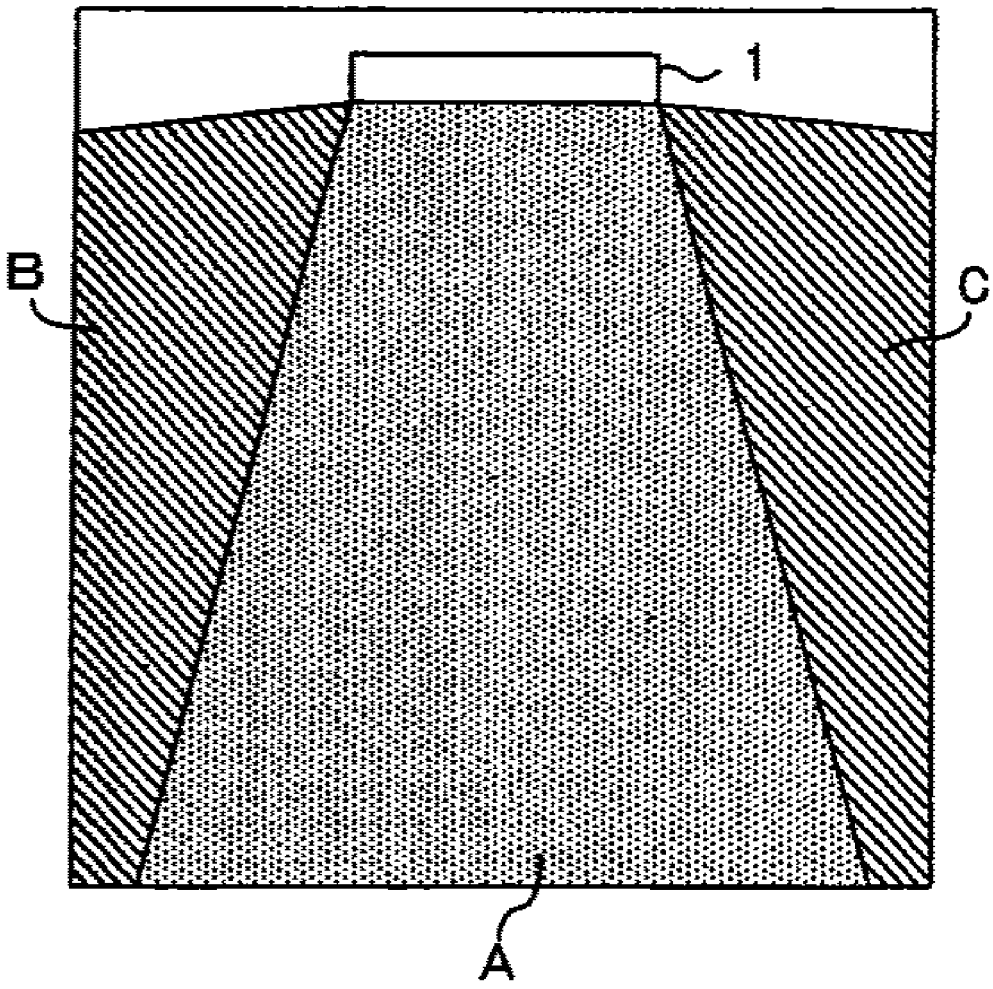
FIG. 8 is a view showing a region where the point sound source movement mode is executed, and that where a delay control mode is executed.

In the speaker array apparatus 1, setting may be conducted so that one of the point sound source movement mode and the delay control mode is performed in accordance with the changed listening position. FIG. 8 is a view showing a region where the point sound source movement mode is executed, and that where the delay control mode is executed.

It may be set so that, when, as shown in FIG. 8, the listening position of the listener U is in a trapezoidal region A which is set in front of the speaker array apparatus 1, the point sound source movement mode is selected, and, when the listening position is in the other region like a region B or C, the delay control mode is selected.

In the case where the listening position is changed to the region B or C, even when a virtual surround sound field is to be produced in the point sound source movement mode, there arises a case where a surround sound field cannot be sensed. By contrast, in the delay control mode, even when the listening position is in the region B or C, a virtual surround sound field can be sensed. When, as described above, the mode of producing a virtual surround sound field is switched over in accordance with the region where the changed listening position is, therefore, a virtual surround sound field can be properly produced irrespective of the changed listening position.

In the above, the configuration in which, when the remote controller 5 is operated, the listening position can be again set in the virtual surround mode has been described. The invention is not restricted to this. A method such as that in which a magnetic sensor, an ultrasonic transmitter, an IR beacon, a radio transmitter, or the like is attached to the listener and the position of the listener is detected by the speaker array apparatus 1, or that in which the listener is found by a camera, a temperature sensor, or the like and the listening position is detected may be employed. According to the configuration, in the case where the listening position of the listener can be detected in real time, in the virtual surround mode, the HRTF calculating portion 19 performs a calculation for forming a wavefront similar to that formed by sounds emitted from the virtual point sound sources, and that of localization characteristics of sounds of the channels based on a head-related transfer function, on the basis of the information of the listening position of the listener, and the phase controlling portion 21 is controlled on the basis of results of the calculations, whereby the listening position can be changed (corrected) in real time. Also in the virtual surround mode, therefore, the listening position is not fixed but can be freely changed.

In the speaker array apparatus 1, also in the real surround mode due to sound beams, when the listening position is changed and the remote controller 5 is operated, the directions of emitting the sound beams can be changed so that a surround sound field is produced at the changed listening position.

What is claimed is:

1. A speaker array apparatus comprising:

a speaker array that emits sounds of a plurality of channels;

a beam formation calculating section that performs a calculation for controlling phases of the sounds so that the speaker array emits sound beams in directions set for the respective channels;

a sound source localization applying section that performs a calculation for controlling the phases of the sounds emitted from the speaker array so as to form a plurality of virtual point sound sources, and performs a calculation of auditory sensation characteristics at a listening position on a basis of a head-related transfer function;

a selecting section that selects one of the beam formation calculating section or the sound source localization applying section; and a phase controlling section that controls the phases of the sounds emitted from the speaker array on a basis of a calculation result of the beam formation calculation section selected by the selecting section or applies the auditory sensation characteristics and controls the phase of a wavefront from the virtual point sound source on a basis of a calculation result of the sound source localization applying section selected by the selecting section;

a test sound outputting section that outputs a test sound signal and a signal for controlling the phases to the phase controlling section so that the speaker array emits test sound beams while sweeping the test sound beams; and a microphone that is disposed at the listening position of the listener, and picks up direct and reflected sounds of the test sound beams emitted from the speaker array, wherein the selecting section analyzes sound data of the test sound beams picked up by the microphone, and selects one of the beam formation calculating section or the sound source localization applying section in accordance with a result of the analysis.

2. The speaker array apparatus according to claim 1 wherein:

the phases of the sounds emitted from the speaker array is controlled so that a wavefront formed by the sounds emitted from the speaker array is similar to a wavefront formed by sounds emitted from the virtual point sound sources, and the auditory sensation characteristics are calculated so that a listener who listens at the listening position to the sounds emitted from the virtual point sound sources feels localization at positions set for the respective channels.

3. A speaker array apparatus comprising:

a speaker array that emits sounds of a plurality of channels;

a beam formation calculating section that performs a calculation for controlling phases of the sounds so that the speaker array emits sound beams in directions set for the respective channels;

a sound source localization applying section that performs a calculation for controlling the phases of the sounds emitted from the speaker array so as to form a plurality of virtual point sound sources, and performs a calculation of auditory sensation characteristics at a listening position on a basis of a head-related transfer function;

a selecting section that selects one of the beam formation calculating section or the sound source localization applying section; and a phase controlling section that controls the phases of the sounds emitted from the speaker array on a basis of a calculation result of the beam formation calculation section selected by the selecting section or applies the auditory sensation characteristics and controls the phase of a wavefront from the virtual point sound source on a basis of a calculation result of the sound source localization applying section selected by the selecting section;

a position detecting section that detects the listening position of the listener, and outputs information of the position, wherein, when the sound source localization applying section is selected by the selecting section and the position information output from the position detecting section is changed, the sound source localization applying section performs the calculation for controlling the phases of the sounds emitted from the speaker array, or the calculation of the auditory sensation characteristics.

4. The speaker array apparatus according to claim 3, wherein, when the listening position is changed, the sound source localization applying section performs a calculation for controlling the phases of the sounds emitted from the speaker array so that positions of the virtual point sound sources are changed in positional relationships similar to the virtual point sound sources relative to the listening position before the change, and a wavefront similar to a wavefront formed by the sounds emitted from the virtual point sound sources before the change is formed.

5. The speaker array apparatus according to claim 3, wherein, when the listening position is changed, the sound source localization applying section performs a calculation of a phase control to delay sound emission timings of the virtual point sound sources so that arrival times of sounds to the listening position after the listening position is changed are substantially identical with arrival times of sounds to the listening position before the listening position is changed.

6. The speaker array apparatus according to claim 3, wherein, when the listening position is changed, the sound source localization applying section calculates, on the basis of the head-related transfer function, the auditory sensation characteristics at the listening position after changed.

7. The speaker array apparatus according to claim 3, wherein:

the sound source localization applying section performs a calculation for controlling the phases of the sounds emitted from the speaker array so that positions of the virtual point sound sources are changed in same positional relationships as the virtual point sound sources relative to the listening position before the change, and a wavefront similar to a wavefront formed by sounds emitted from the virtual point sound sources before the change is formed when the changed listening position is within a predetermined range in front of the speaker array, and the sound source localization applying section performs a calculation of a phase control to delay sound emission timings of the virtual point sound sources when the changed listening position is outside the predetermined range.

8. The speaker array apparatus according to claim 3, wherein:

the phases of the sounds emitted from the speaker array is controlled so that a wavefront formed by the sounds emitted from the speaker array is similar to a wavefront formed by sounds emitted from the virtual point sound sources, and the auditory sensation characteristics are calculated so that a listener who listens at the listening position to the sounds emitted from the virtual point sound sources feels localization at positions set for the respective channels.

* * * * *